United States Patent [19]

Gerke, Jr. et al.

[11] Patent Number: 4,947,514

[45] Date of Patent: Aug. 14, 1990

[54] INTERNAL CONTACT FOR A CHARGING CIRCUIT

[75] Inventors: Burton E. Gerke, Jr., Newtown; Michael E. Bitzel, Monroe; Robert Kubicko, Huntington; Charles Z. Krasznai, Trumbull, all of Conn.

[73] Assignee: Black & Decker, Inc., Newark, Del.

[21] Appl. No.: 294,440

[22] Filed: Jan. 9, 1989

[51] Int. Cl.[5] ..... A47L 9/28

[52] U.S. Cl. ..... 15/339; 15/344; 15/DIG. 1; 320/2

[58] Field of Search ..... 15/339, 344, DIG. 1; 320/2

[56] References Cited

U.S. PATENT DOCUMENTS 4,209,875 7/1980 Pugh et al. .
4,306,558 12/1981 Kurtz et al. .
4,421,964 12/1983 Buchtel .
4,542,557 9/1985 Levine .
4,573,234 3/1986 Kochte et al. .
4,610,048 9/1986 Ishihara et al. .
4,665,582 3/1987 Richmond et al. .
4,670,701 6/1987 Sako et al. ..... 320/2

*Primary Examiner*—Chris K. Moore
*Attorney, Agent, or Firm*—Barry E. Deutsch

[57] ABSTRACT

The present invention is a vacuum cleaner recharging assembly. The assembly includes a vacuum cleaner having a motor, a housing enclosing the motor, a fan driven by the motor for producing a vacuum, and a canister for at least the reception of foreign matter and air drawn into the canister in response to the vacuum produced by the fan. The vacuum cleaner has a power source for powering the motor and electrical wiring interconnecting the motor and the power source. The assembly also includes a charging unit cooperable with the vacuum cleaner for charging the power source. The assembly further includes circuitry for disconnecting the flow of electrical power from the power source to the motor when the vacuum cleaner and the charging unit are operatively engaged to allow optimum charging of the power source.

5 Claims, 4 Drawing Sheets

INTERNAL CONTACT FOR A CHARGING CIRCUIT

BACKGROUND OF THE INVENTION

1. Field of the Invention

The present invention relates generally to portable vacuum cleaners, more particularly to, a vacuum cleaner capable of operating with both air and liquid.

2. Description of Related Art

Currently, there exists portable vacuum cleaners which pick up or vacuum solid or liquid material. These portable vacuum cleaners are frequently referred to as "wet-dry" vacuum cleaners. Commonly, such vacuum cleaners include an electric motor for imparting rotation to a fan to create a partial vacuum. The motor is typically connected by electrical wiring to a plurality of batteries acting as the power source to power the motor. The vacuum cleaner also includes a switch which provides for the coupling of electric power from the batteries to the motor. The vacuum cleaner further includes a charging circuit for removable connection to a battery charging unit for charging the batteries during a period of non-use of the vacuum cleaner.

One disadvantage of current portable or hand-held vacuum cleaners is that the switch may be left in an operable position when the vacuum cleaner is placed on the battery charging unit. As a result, the motor may operate while the batteries of the vacuum cleaner are charging. This prevents the batteries from receiving the maximum charge possible.

It is, therefore, an object of the present invention to prevent electrical power flow from the batteries to the motor if the switch is left in an operable position when the vacuum cleaner is placed on the battery charging unit to ensure that the batteries are always charging.

SUMMARY OF THE INVENTION

Accordingly, the present invention is a vacuum cleaner recharging assembly. The assembly includes a vacuum cleaner having a motor, a housing enclosing the motor, a fan driven by the motor for producing a vacuum, and a canister for at least the reception of foreign matter and air drawn into the canister in response to the vacuum produced by the fan. The vacuum cleaner has a power source for powering the motor and electrical wiring interconnecting the motor and the power source. The assembly also includes a charging unit cooperable with the vacuum cleaner for charging the power source. The assembly further includes means for disconnecting the flow of electrical power from the power source to the motor when the vacuum cleaner and the charging unit are operatively engaged to allow optimum charging of the power source.

One advantage of the present invention is that the operating switch may be placed in any operable position when the vacuum cleaner is returned to the battery charging unit and electrical power will be prevented from flowing from the batteries to the motor. This ensures that the batteries will receive the maximum charge when charging.

Other advantages of the present invention will be readily appreciated as the same becomes better understood by reference to the following detailed description when considered in connection with the accompanying drawings.

DESCRIPTION OF THE PREFERRED EMBODIMENT

Figure 1:
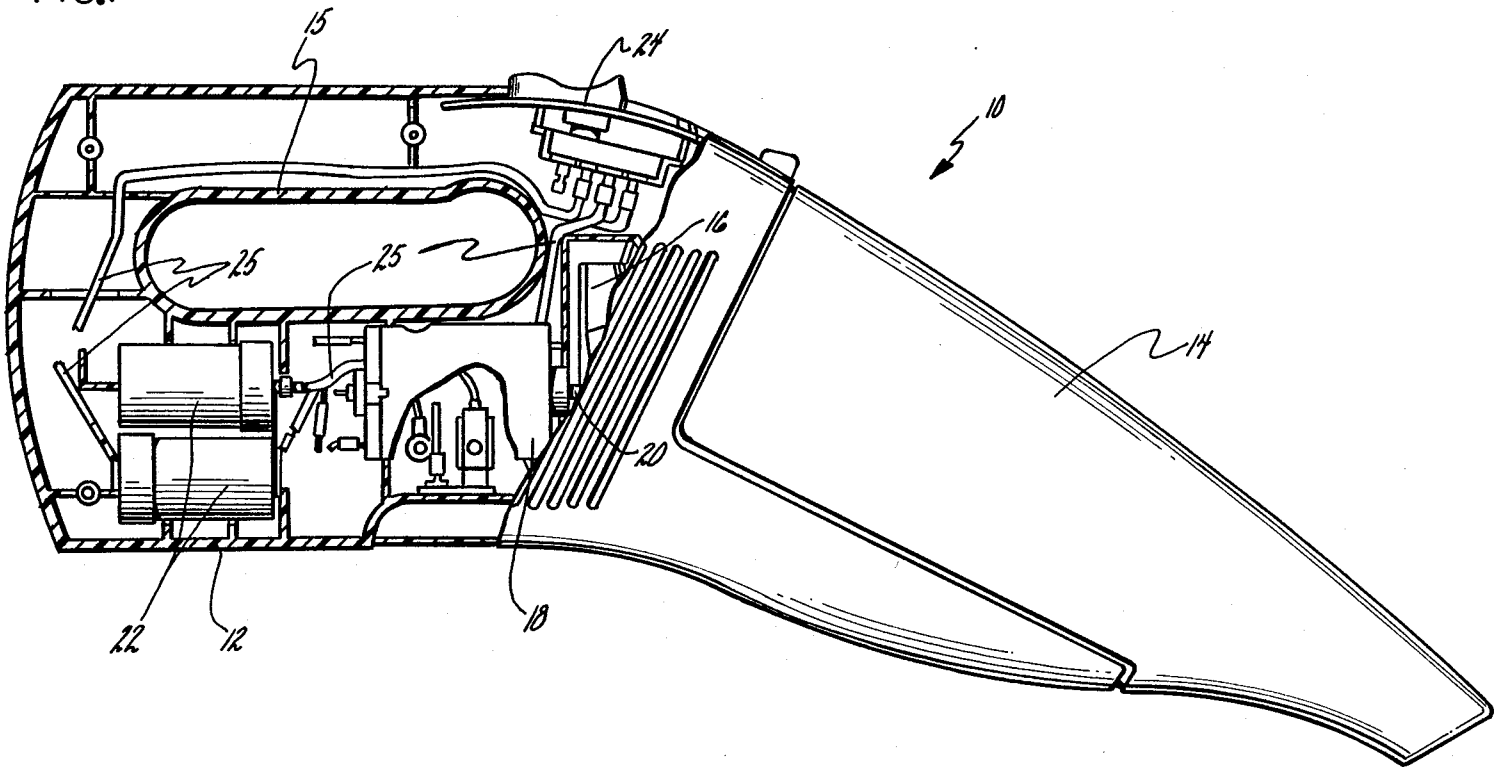
FIG. 1 is an elevational view with a portion broken away of a vacuum cleaner incorporating the present invention.
Figure 2:
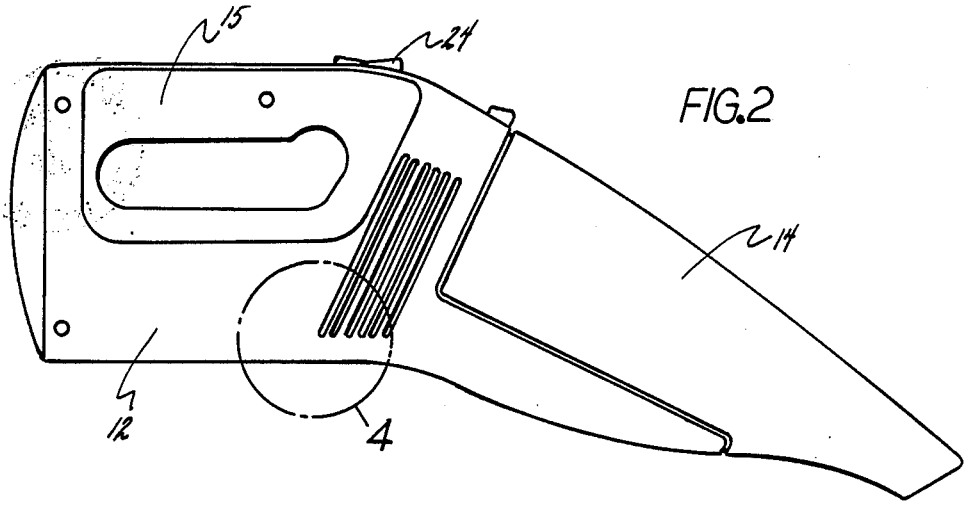
FIG. 2 is an elevational view of the vacuum cleaner of FIG. 1.

Referring to FIGS. 1 and 2, a vacuum cleaner 10 incorporating the present invention is shown. The vacuum cleaner 10 comprises a central housing 12 having a canister 14 affixed to a front end thereof and a handle 15 formed near the back end thereof. The handle 15 is configured to be grasped by the hand of a person using the vacuum cleaner 10 for the cleaning of upholstery, rugs, as well as in the dusting of flat surfaces such as the top of a table.

The vacuum cleaner 10 includes a source of suction or fan 16 contained within the housing 12 and which may also be referred to as a blower or impeller. The vacuum cleaner 10 also includes an electric motor 18 coupled by a shaft 20 to the fan 16. Rotation of the shaft 20 by the motor 18 imparts rotation to the fan 16 to create a partial vacuum and the accompanying suction which draws air and foreign matter into the canister 14. The motor 18 is powered by a plurality of batteries 22.

Figure 3:
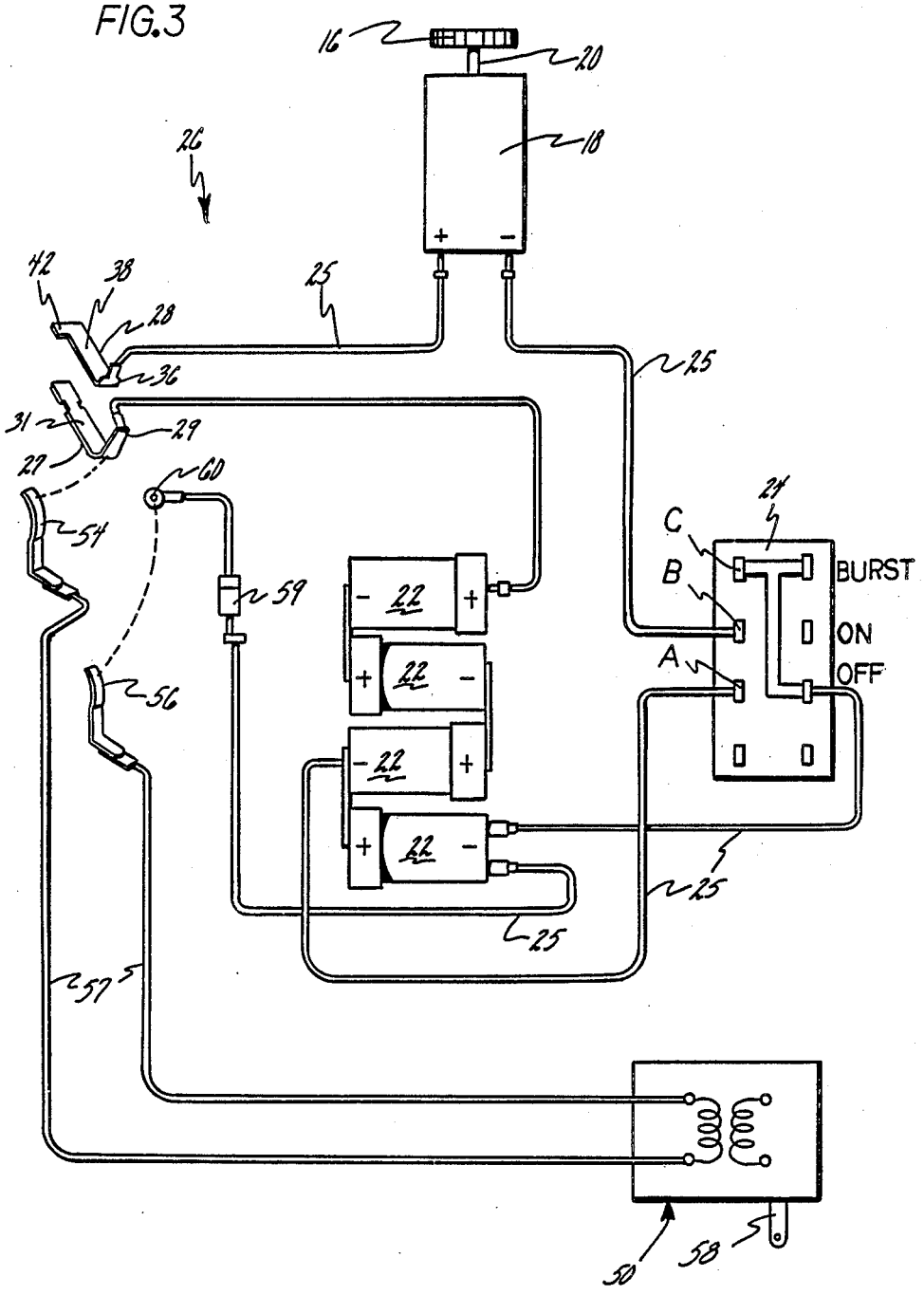
FIG. 3 is an electrical circuit schematic for the vacuum cleaner of FIGS. 1 and 2.

A multi-position switch 24 is positioned on the upperside of the handle 15 for convenient engagement by means of the thumb of a person utilizing the vacuum cleaner 10. The switch 24 preferably has three positions, an "OFF" position "A" which prevents electrical current or power flow from the batteries 22 to the motor 18, an "ON" position "B" which allows electrical power flow from the batteries 22 to the motor 18, and a "BURST" position "C" which changes the amount of electrical power flow from the batteries 22 to the motor 18. Operation of the switch 24 to the ON position B or BURST position C as illustrated in FIG. 3 provides for the coupling of electric power from the batteries 22 to the motor 18 for activation of the motor 18. Electrical wiring 25 connects the batteries 22 to the switch 24 and the motor 18. Additionally, the switch 24 is biased by means such as a spring to remain in the ON position B from the BURST position C.

Referring to FIG. 3, an electrical circuit 26 for the vacuum cleaner 10 is shown. The electrical circuit 26 includes the motor 18, switch 24 and batteries 22. The electrical circuit 26 also includes a pair of contacts 27 and 28 interconnecting the motor 18 and batteries 22. The first contact 27 is connected by the electrical wiring 25 to the positive terminal of the first battery 22. The second contact 28 is connected by the electrical wiring 25 to the positive terminal of the motor 18.

Figure 4:
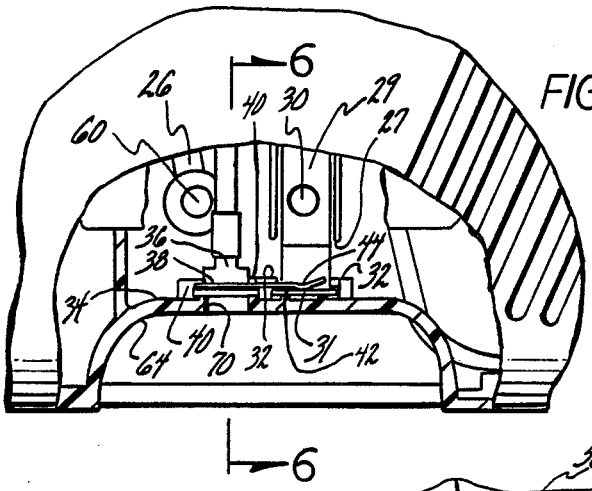
FIG. 4 is a partial elevational view broken away of the portion circled in FIG. 2.

Referring to FIGS. 3 and 4, the first contact 27 is generally "L" shaped and has a vertical portion 29 secured by a rivet 30 to the housing 12 such that the rivet 30 extends through the housing 12. The contact 27 also has a horizontal portion 31 which is secured to the housing 12 by a pair of brackets 32 formed on an interior surface 34 of the housing 12. The second contact 28 is generally "L" shaped and has a vertical portion 36 and a horizontal portion 38 extending outwardly from the vertical portion 36. The horizontal portion 38 is secured to the housing 12 near the vertical portion 36 by a pair of brackets 40 formed on the interior surface 34 of the housing 12.

Figure 6:
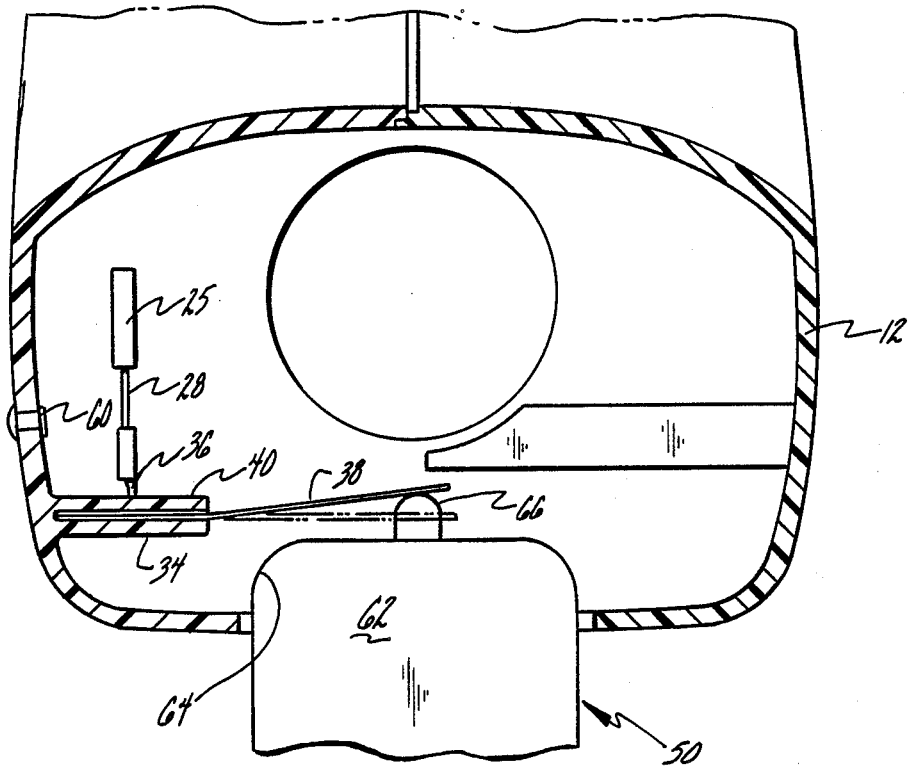
FIG. 6 is a sectional view taken along line 6—6 of FIG. 4.

Referring to FIG. 6, the brackets 40 extend only partially along the length of the horizontal portion 38 to allow the free end of the horizontal portion 38 to be deflected upwardly from an undeflected position shown in phantom in the figure to a deflected position shown in solid in the figure. Referring again to FIGS. 3 and 4, the second contact 28 includes a flange 42 extending at a generally right angle from the horizontal portion 38 toward the horizontal portion 31 of the first contact 27. The flange 42 includes a downwardly extending projection 44 which contacts or abuts the horizontal portion 31 of the first contact 27.

When the contacts 27 and 28 touch or abut each other in a first closed position, electrical current may flow from the batteries 22 to the motor 18 when the switch 24 is in an operable or ON position B. When the contacts 27 and 28 are separated in a second open position as illustrated in FIGS. 5 and 6, an open circuit will exist and current will be prevented from flowing from the batteries 22 to the motor 18 when the switch 24 is in the ON position B or the BURST position C.

Referring to FIG. 3, a battery or power source charging unit 50 for charging the batteries 22 during a period of non-use of the vacuum cleaner 10 is shown. The charging unit 50 may be connected by a suitable electric cord or the like for engaging an electrical convenience power outlet in the home or other location where the vacuum cleaner 10 is to be stored. The charging unit 50, typically comprises a base 52 (FIG. 5) adapted to be supported by a support surface. The base 52 includes a pair of terminal strips 54 and 56 connected by electrical wiring 57 to a male plug 58 or the like. A negative end of a fourth battery 22 is connected by electrical wiring 25 through a charging diode 59 to a rivet 60. The rivet 60 extends through the housing 12 as illustrated in FIG. 4. When the vacuum cleaner 10 engages the charging unit 50, the terminal strips 54 and 56 touch or contact the rivets 60 and 30, respectively, and electrical power is coupled from the electrical convenience power outlet to the batteries 22.

Figure 5:
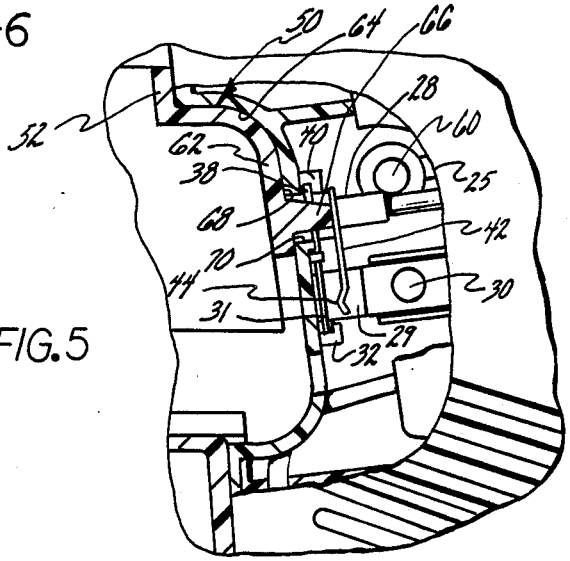
FIG. 5 is a view similar to FIG. 4 rotated ninety degrees with the vacuum cleaner engaging a charging unit.

Referring to FIGS. 4 and 5, the base 52 includes a pedestal 62 which is generally rectangular in cross-section and extending outwardly from the base 52. The pedestal 62 is removably disposed in a correspondingly shaped cavity 64 formed in the housing 12 of the vacuum cleaner 10 when the vacuum cleaner 10 engages the charging unit 50 for charging the batteries 22. The pedestal 62 includes a safety post 66, acting as a break or kill switch for the circuit 26, extending outwardly from the upper surface 68 of the pedestal 62. The post 66 is removably disposed through an aperture 70 formed in the housing 12 to move the flange 42 of the second contact 28 to the second open position illustrated in FIGS. 5 and 6.

In operation, when the batteries 22 of the vacuum cleaner 10 need to be charged, the vacuum cleaner 10 is placed on the battery charging unit 50 such that the pedestal 62 is disposed in the cavity 64 of the housing 12. The post 66 deflects the flange 42 of the second contact 28 to separate or open the contacts 27 and 28 to disconnect electrical power from the batteries 22 to the motor 18. As a result, the switch 24 may be in the ON position B or BURST position C and since an open exists in the electrical circuit 26, no electrical current or power will flow from the batteries 22 to the motor 18 while the batteries 22 are being charged. This ensures that the batteries 22 receive the maximum or optimum charge when charging.

The present invention has been described in an illustrative manner. It is to be understood that the terminology which has been used is intended to be in the nature of words of description rather than of limitation.

Obviously, many modifications or variations of the present invention are possible in light of the above teachings. Therefore, within the scope of the appended claims, the present invention may be practiced otherwise than as specifically described.

What is claimed is:

1. A vacuum cleaner regarding assembly comprising:

a vacuum cleaner including a motor, a housing enclosing said motor, a blower driven by said motor for producing a vacuum, a canister for at least the reception of foreign matter and air drawn into said canister in response to the vacuum produced by said blower, a power source for powering said motor, and electrical wiring interconnecting said motor and said power source;

a charging unit cooperable with said vacuum cleaner for charging said power source;

means for disconnecting the flow of electrical power to said motor when said vacuum cleaner and said charging unit are operatively engaged to allow optimum charging of said power source;

a switch connected electrically to said power source and said motor, said switch having a nonoperable position to prevent the flow of electrical power from said power source to said motor and an operable position to allow the flow of electrical power from said power source to said motor, said disconnecting means comprising a pair of contacts having a first position engaging each other for allowing the flow of electrical power between said power source and said motor when said switch is in said operable position; and a protrusion on said charging unit for engaging one of said pair of contacts to move said one of said pair of contacts to a second position disengaging each other for discontinuing the flow of electrical power between said power source and said motor when said switch is in said operable position.

2. An assembly as set forth in claim 1 wherein said vacuum cleaner includes means forming an aperture in said housing, one of said pair of contacts being disposed within said housing across said aperture.

3. An assembly as set forth in claim 2 wherein said one of said pair of contacts is pivotally connected at one end and the other end is freely depending therefrom.

4. A vacuum cleaner recharging assembly comprising:

a vacuum cleaner including a motor, a housing enclosing said motor, a blower driven by said motor for producing a vacuum, a canister for at least the reception of foreign matter and air drawn into said canister in response to the vacuum produced by said blower, a power source for powering said motor, and electrical wiring interconnecting said motor and said power source;

a charging unit cooperable with said vacuum cleaner for charging said power source;

means for disconnecting the flow of electrical power to said motor when said vacuum cleaner and said charging unit are operatively engaged to allow charging of said power source including a pair of contacts having a first position engaging each other for allowing the flow of electrical power between said power source and said motor when said switch is in said operable position, and a protrusion on said charging unit for engaging one of said pair of contacts to move said one of said pair of contacts to a second position disengaging each other for discontinuing the flow of electrical power between said power source and said motor when said switch is in said operable position; and a switch connected electrically to said power source and said motor, said switch having a nonoperable position to prevent the flow of electrical power from said power source to said motor and an operable position to allow the flow of electrical power from said power source to said motor.

5. An assembly as set forth in claim 4 including means forming an aperture in said housing, one of said pair of contacts being disposed within said housing across said aperture.

* * * * *